US011195451B2

(12) United States Patent
Han et al.

(10) Patent No.: US 11,195,451 B2
(45) Date of Patent: Dec. 7, 2021

(54) VOLTAGE COMPENSATION CIRCUIT AND METHOD TO COMPENSATE GAMMA VOLTAGE AND ENABLING TARGET PIXEL VOLTAGES TO BE CONSISTENT

(71) Applicants: HEFEI BOE DISPLAY TECHNOLOGY CO., LTD., Anhui (CN); BOE TECHNOLOGY GROUP CO., LTD., Beijing (CN)

(72) Inventors: Yizhan Han, Beijing (CN); Liugang Zhou, Beijing (CN); Jianwei Sun, Beijing (CN); Tao Li, Beijing (CN); Yulong Xiong, Beijing (CN); Chunheng Zhang, Beijing (CN); Qing Li, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/965,917

(22) PCT Filed: Dec. 18, 2019

(86) PCT No.: PCT/CN2019/126221

§ 371 (c)(1),
(2) Date: Jul. 29, 2020

(87) PCT Pub. No.: WO2020/140755

PCT Pub. Date: Jul. 9, 2020

(65) Prior Publication Data

US 2021/0074201 A1 Mar. 11, 2021

(30) Foreign Application Priority Data

Jan. 2, 2019 (CN) ..... 201910002894.0

(51) Int. Cl.
*G09G 3/20* (2006.01)

(52) U.S. Cl.
CPC ... *G09G 3/2092* (2013.01); *G09G 2310/0267* (2013.01); *G09G 2310/0278* (2013.01); *G09G 2320/0276* (2013.01)

(58) Field of Classification Search
CPC ... G09G 2310/0267; G09G 2310/0278; G09G 2320/0276; G09G 2320/0278;
(Continued)

(56) References Cited

U.S. PATENT DOCUMENTS 10,902,803 B2 * 1/2021 Han ..... G09G 3/36
2004/0217981 A1 * 11/2004 Bu ..... G09G 3/3611 345/690

(Continued)

FOREIGN PATENT DOCUMENTS

CN 1982957 A 6/2007
CN 104851407 A 8/2015

(Continued)

OTHER PUBLICATIONS

Office Action dated Jan. 6, 2020 issued in corresponding Chinese Application No. 201910002894.0.

*Primary Examiner* — Alexander Eisen
*Assistant Examiner* — Nelson Lam
(74) *Attorney, Agent, or Firm* — Nath, Goldberg & Meyer; Joshua B. Goldberg

(57) ABSTRACT

The present disclosure provides a voltage compensation circuit and a voltage compensation method, a display driving circuit and a display device. The voltage compensation circuit includes: a voltage analyzing sub-circuit and a gamma voltage generating sub-circuit. The voltage analyzing sub-circuit is coupled to the display panel and configured to obtain pixel voltages of target pixels in the image to be detected; judge whether the display panel is abnormal according to the pixel voltages; generate a compensation control signal in response to that the display panel is abnormal. The gamma voltage generating sub-circuit is coupled to the voltage analyzing sub-circuit and is configured to compensate a gamma voltage corresponding to the
(Continued)

image to be detected according to the compensation control signal so as to enable the pixel voltages of the target pixels to be consistent.

20 Claims, 6 Drawing Sheets

(58) Field of Classification Search
CPC ..... G09G 3/2092; G09G 3/30; G09G 3/32; G09G 3/3208; G09G 3/3216; G09G 3/3225; G09G 3/3233; G09G 3/3241; G09G 3/36; G09G 3/3607; G09G 3/3622; G09G 3/3625; G09G 3/364; G09G 3/3644; G09G 3/3648
USPC ..... 345/76–83, 87–104
See application file for complete search history.

(56) References Cited

U.S. PATENT DOCUMENTS

2006/0244692 A1* 11/2006 Yoo ..... G09G 3/3275 345/76
2010/0045583 A1* 2/2010 Park ..... G09G 3/3648 345/90
2014/0225942 A1* 8/2014 Liu ..... G09G 3/36 345/694
2015/0356932 A1* 12/2015 Kim ..... G09G 3/3688 345/690
2016/0049113 A1* 2/2016 Park ..... G09G 3/3266 345/212
2016/0189642 A1 6/2016 Shin et al.
2016/0351157 A1 12/2016 Pyun
2017/0018219 A1* 1/2017 Wang ..... G09G 3/2092
2018/0233100 A1* 8/2018 Shin ..... G09G 3/3677
2020/0013348 A1* 1/2020 Lee ..... G09G 3/3413
2020/0013354 A1* 1/2020 Han ..... G09G 3/3696

FOREIGN PATENT DOCUMENTS

CN 107886917 A 4/2018
CN 108597428 A 9/2018
CN 108597466 A 9/2018
CN 108630165 A 10/2018
CN 108648704 A 10/2018
CN 109616067 A 4/2019
KR 10-2007-0077348 A 7/2007

* cited by examiner

VOLTAGE COMPENSATION CIRCUIT AND METHOD TO COMPENSATE GAMMA VOLTAGE AND ENABLING TARGET PIXEL VOLTAGES TO BE CONSISTENT

CROSS-REFERENCE TO RELATED APPLICATIONS

This is a National Phase Application filed under 35 U.S.C. 371 as a national stage of PCT/CN2019/126221, filed Dec. 18, 2019, an application claiming the benefit of Chinese Application No. 201910002894.0, filed Jan. 2, 2019, the content of each of which is hereby incorporated by reference in its entirety.

TECHNICAL FIELD

Embodiments of the present disclosure relate to the field of display technology, in particular to a voltage compensation circuit, a voltage compensation method, a display driving circuit and a display device.

BACKGROUND

With rapid development of the field of display panels, people's demand for large-sized high-resolution display panels is increasing day by day, and requirements for a display effect of display panel products are higher and higher.

The inventors found that, in the display panel, due to the fact that a resistance of a common electrode is too large and a coupling capacitance between the common electrode and a data line is too large, voltage on the data line jumps to cause unstable voltage on the common electrode, so that the display panel has a problem of horizontal crosstalk, and further causes display problems such as uneven brightness and darkness of a picture, flickering and the like, and the display effect is poor.

SUMMARY

An embodiment of the present disclosure provides a voltage compensation circuit for a display panel, where the display panel is configured to display an image to be detected, the voltage compensation circuit includes: a voltage analyzing sub-circuit and a gamma voltage generating sub-circuit, the voltage analyzing sub-circuit is coupled to the display panel and is configured to acquire pixel voltages of target pixels in the image to be detected, judge whether the display panel is abnormal or not according to the pixel voltages; and generate a compensation control signal in response to that the display panel is abnormal; and the gamma voltage generating sub-circuit is coupled to the voltage analyzing sub-circuit and is configured to compensate a gamma voltage corresponding to the image to be detected according to the compensation control signal so as to enable the pixel voltages of the target pixels to be consistent.

In some implementations, the gamma voltage generating sub-circuit is further configured to generate a target gamma voltage to make the display panel display according to the target gamma voltage, where the target gamma voltage is a gamma voltage which is compensated and enables the pixel voltages of the target pixels to be consistent.

In some implementations, the image to be detected includes: a first display region and a second display region, the first display region surrounds the second display region;

the display panel includes m rows of scanning lines and N columns of data lines, the target pixels include a first pixel, a second pixel and a third pixel, where M is greater than or equal to 1, and N is greater than or equal to 1; the first pixel is defined by an intersection of a first scanning line and a last column of data line, the second pixel is defined by an intersection of a second scanning line and the last column of data line, and the third pixel is defined by an intersection of a third scanning line and the last column of data line; the first scanning line is a scanning line which is located at a same horizontal line as an upper border of the second display region, the second scanning line is a scanning line which is located at a same horizontal line as a lower border of the second display region, and the third scanning line is a scanning line located between the first scanning line and the second scanning line.

In some implementations, the voltage analyzing sub-circuit includes a comparison sub-circuit and an output control sub-circuit, the comparison sub-circuit is respectively coupled to a first signal input terminal, a second signal input terminal and a third signal input terminal and is configured to obtain a first difference value and a second difference value according to signals from the first signal input terminal, the second signal input terminal and the third signal input terminal; the first signal input terminal is configured to provide a pixel voltage of the first pixel, the second signal input terminal is configured to provide a pixel voltage of the second pixel, and the third signal input terminal is configured to provide a pixel voltage of the third pixel; the output control sub-circuit is respectively coupled to the comparison sub-circuit and a signal output terminal and is configured to judge whether the display panel is abnormal or not according to the first difference value and the second difference value, generate a compensation control signal in response to that the display panel is abnormal and provide the compensation control signal to the signal output terminal.

In some implementations, the comparison sub-circuit includes a first comparison sub-circuit and a second comparison sub-circuit; the first comparison sub-circuit is respectively coupled to the first signal input terminal and the second signal input terminal, and is configured to obtain the first difference value according to signals of the first signal input terminal and the second signal input terminal; the second comparison sub-circuit is respectively coupled to the second signal input terminal and the third signal input terminal, and is configured to obtain the second difference value according to signals of the second signal input terminal and the third signal input terminal.

In some implementations, the first comparison sub-circuit includes a first resistor, a second resistor, a third resistor, a first reference resistor and a first subtractor; a first terminal of the first resistor is coupled to the first signal input terminal, and a second terminal of the first resistor is coupled to a first input terminal of the first subtractor; a first terminal of the second resistor is coupled to the second signal input terminal, and a second terminal of the second resistor is coupled to a second input terminal of the first subtractor; a first terminal of the third resistor is coupled to the second input terminal of the first subtractor, and a second terminal of the third resistor is grounded; a first terminal of the first reference resistor is coupled to the first input terminal of the first subtractor, and a second terminal of the first reference resistor is coupled to an output terminal of the first subtractor; the output terminal of the first subtractor is coupled to the output control sub-circuit, where the first resistor and the second resistor has a same resistance value, and the third resistor and the first reference resistor has a same resistance value.

In some implementations, the second comparison sub-circuit includes a fourth resistor, a fifth resistor, a sixth resistor, a second reference resistor and a second subtractor; a first terminal of the fourth resistor is coupled to the second signal input terminal, and a second terminal of the fourth resistor is coupled to a first input terminal of the second subtractor; a first terminal of the fifth resistor is coupled to the third signal input terminal, and a second terminal of the fifth resistor is coupled to the second input terminal of the second subtractor; a first terminal of the sixth resistor is coupled to the second input terminal of the second subtractor, and a second terminal of the sixth resistor is grounded; a first terminal of the second reference resistor is coupled to the first input terminal of the second subtractor, and a second terminal of the second reference resistor is coupled to an output terminal of the second subtractor; the output terminal of the second subtractor is coupled to the output control sub-circuit; where the fourth resistor and the fifth resistor has a same resistance value, and the sixth resistor and the second reference resistor has a same resistance value.

In some implementations, the output control sub-circuit is configured to determine whether the first difference value and the second difference value are both less than a threshold value, and determine that the display panel is abnormal in response to that the first difference value or the second difference value is greater than or equal to the threshold value.

In some implementations, the output control sub-circuit includes an OR gate circuit; a first terminal of the OR gate circuit is coupled to the output terminal of the first subtractor, a second terminal of the OR gate circuit is coupled to the output terminal of the second subtractor, and an output terminal of the OR gate circuit is coupled to the signal output terminal.

In some implementations, the voltage analyzing sub-circuit includes a first resistor, a second resistor, a third resistor, a first reference resistor, a first subtractor, a fourth resistor, a fifth resistor, a sixth resistor, a second reference resistor, a second subtractor and an OR gate circuit, a first terminal of the first resistor is coupled to the first signal input terminal, and a second terminal of the first resistor is coupled to a first input terminal of the first subtractor; a first terminal of the second resistor is coupled to the second signal input terminal, and a second terminal of the second resistor is coupled to a second input terminal of the first subtractor; a first terminal of the third resistor is coupled to the second input terminal of the first subtractor, and a second terminal of the third resistor is grounded; a first terminal of the first reference resistor is coupled to the first input terminal of the first subtractor, and a second terminal of the first reference resistor is coupled to an output terminal of the first subtractor; the output terminal of the first subtractor is coupled to a first input terminal of the OR gate circuit; a first terminal of the fourth resistor is coupled to the second signal input terminal, and a second terminal of the fourth resistor is coupled to a first input terminal of the second subtractor; a first terminal of the fifth resistor is coupled to a third signal input terminal, and a second terminal of the fifth resistor is coupled to a second input terminal of the second subtractor; a first terminal of the sixth resistor is coupled to the second input terminal of the second subtractor, and a second terminal of the sixth resistor is grounded; a first terminal of the second reference resistor is coupled to the first input terminal of the second subtractor, and a second terminal of the second reference resistor is coupled to an output terminal of the second subtractor; the output terminal of the second subtractor is coupled to a second input terminal of the OR gate circuit; and an output terminal of the OR gate circuit is coupled to the signal output terminal.

In some implementations, the gamma voltage generating sub-circuit is configured to compensate a gamma voltage corresponding to a gray scale of the second display region by using a threshold compensation voltage according to the compensation control signal, until the pixel voltages of the target pixels are consistent.

An embodiment of the present disclosure further provides a display driving circuit, including: the above voltage compensation circuit.

An embodiment of the present disclosure further provides a display device, including: a display panel and the above display driving circuit.

An embodiment of the present disclosure further provides a voltage compensation method applied to the above voltage compensation circuit, the voltage compensation method including: obtaining, by the voltage analyzing sub-circuit, pixel voltages of target pixels in an image to be detected, judging, by the voltage analyzing sub-circuit, whether the display panel is abnormal or not according to the pixel voltages, and generating, by the voltage analyzing sub-circuit, a compensation control signal in response to that the display panel is abnormal; and compensating, by the gamma voltage generating sub-circuit, the gamma voltage corresponding to the image to be detected according to the compensation control signal so as to enable the pixels voltages of the target pixels to be consistent.

In some implementations, the voltage analyzing sub-circuit judging whether the display panel is abnormal or not according to the pixel voltages includes: obtaining, by the voltage analyzing sub-circuit, a first difference value according to signals of the first signal input terminal and the second signal input terminal, obtaining, by the voltage analyzing sub-circuit, a second difference value according to signals of the second signal input terminal and the third signal input terminal, judging whether the first difference value and the second difference value are both smaller than a threshold value, and determining that the display panel is abnormal in response to that the first difference value or the second difference value is larger than or equal to the threshold value; where the target pixels includes a first pixel, a second pixel, and a third pixel, the first signal input terminal is configured to provide a pixel voltage of the first pixel, the second signal input terminal is configured to provide a pixel voltage of the second pixel, and the third signal input terminal is configured to provide a pixel voltage of the third pixel.

In some implementations, compensating, by the gamma voltage generating sub-circuit, the gamma voltage corresponding to the image to be detected according to the compensation control signal includes: compensating, by the gamma voltage generating sub-circuit, the gamma voltage corresponding to a gray scale of the second display region according to the compensation control signal by using a threshold compensation voltage, until the pixel voltages of the target pixels are consistent.

DESCRIPTION OF DRAWINGS

The accompanying drawings, which are included to provide a further understanding of the disclosure and constitute a part of this specification, are used for explaining the present disclosure together with the following embodiments, but do not constitute a limitation to the present disclosure. In the drawings.

DESCRIPTION OF EMBODIMENTS

Figure 1A:
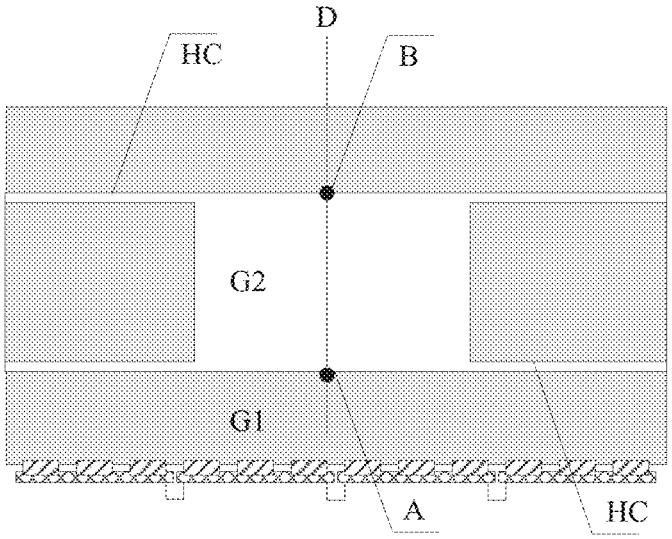
FIG. 1A is a diagram illustrating horizontal crosstalk of a display panel according to the related art.

To make objects, technical solutions and advantages of the present disclosure more apparent, embodiments of the present disclosure will be described in detail below with reference to the accompanying drawings. It should be noted that the embodiments and features of the embodiments in the present application may be arbitrarily combined with each other without conflict.

The steps illustrated in the flow charts in the drawings may be performed in a computer system such as a set of computer-executable instructions. Further, while a logical order is shown in the flow charts, in some cases, the steps shown or described may be performed in an order different from that shown here.

Unless otherwise defined, technical or scientific terms used in the embodiments of the present disclosure should have ordinary meanings as understood by those skilled in the art to which the present disclosure belongs. The use of "first", "second" and similar terms in the embodiments of the disclosure is not intended to indicate any order, quantity, or importance, but rather is to distinguish one element from another. The word "comprising", "comprises", or the like, means that the element or item preceding the word comprises the element or item listed after the word and its equivalent, but does not exclude other elements or items. The terms "coupled" and the like are not restricted to physical or mechanical connections, but may include electrical connections, whether direct or indirect.

In the related art, a display panel displays a specified crosstalk detection image to detect whether or not horizontal crosstalk exists in the display panel, FIG. 1A is a schematic diagram of a crosstalk detection image in which horizontal crosstalk occurs in the related art, as shown in FIG. 1A, the crosstalk detection image includes: a first image G1 and a second image G2, the first image G1 surrounding the second image G2, for example, the first image G1 is a rectangular frame having a length and a width which are equivalent to those of the display panel respectively and has a gray scale of 63, and the second image G2 is a rectangular frame having a length and a width which are half of those of the display panel respectively and has a gray scale of 255, and as shown in FIG. 1A, HC is a white line generated when horizontal crosstalk occurs.

Figure 1B:
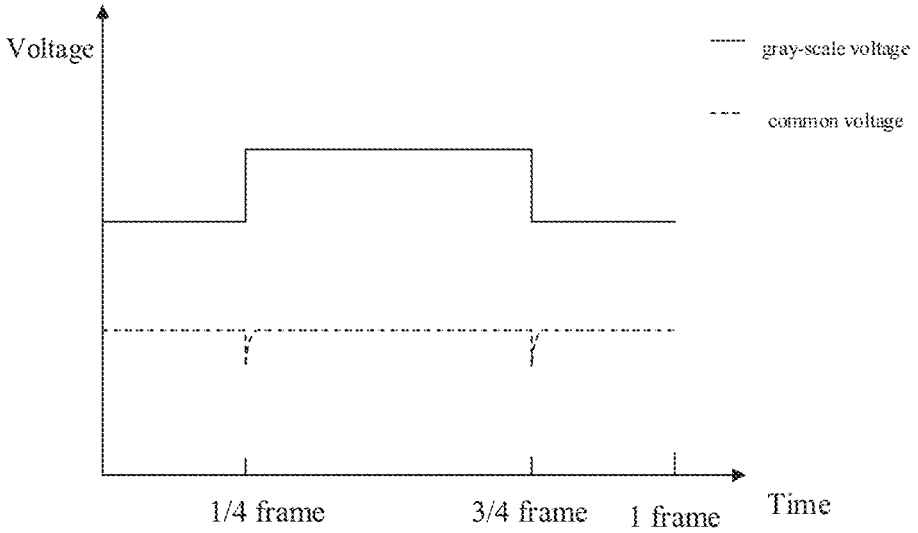
FIG. 1B is a diagram illustrating variations of a signal in the related art.

As shown in FIG. 1A, when the display panel displays, gray-scale voltages of pixels A and B coupled to a data line D and at boundaries of the second image G2 are suddenly changed, specifically, the gray-scale voltage of the pixel A is suddenly increased from a gray-scale voltage corresponding to the gray scale of 63 to a gray-scale voltage corresponding to the gray scale of 255, and the gray-scale voltage of the pixel B is suddenly decreased from the gray-scale voltage corresponding to the gray scale of 255 to the gray-scale voltage corresponding to the gray scale of 63. With an influence of processes of a large-sized panel, when the voltage suddenly changes, a power consumption of a driving circuit is relative large, and according to an overall power conservation, power of other parts of the display panel is reduced, so that a common voltage instantaneously drifts downwards and slowly restores to a normal value, FIG. 1B is a schematic diagram of changes of signals in the related art, where the gray-scale voltage is a signal voltage provided by the data line D, the changes of the common voltage and the changes of the gray-scale voltage are as shown in FIG. 1B, it should be noted that the common voltage suddenly changes at times when ¼ of a frame is displayed and ¾ of the frame is displayed, which are determined by display content of the second image, and the common voltage suddenly changes at the boundary of the second image.

Due to downward drift of the common voltage, an effective value of the common voltage is reduced, resulting in that an increased voltage difference between the common voltage and a normal gray-scale voltage. Since a pixel voltage equals to an absolute value of a difference between the gray-scale voltage and the common voltage, the pixel voltage is increased. As shown in FIG. 1, there is a difference between pixel voltages of a pixel located on a same horizontal line as the pixel A and coupled to the last column of data line, a pixel located on a same horizontal line as the pixel B and coupled to the last column of data line and other pixels coupled to the last column of data line, which makes the pixels of several rows at boundaries of gray scales become white overally, and thus results in a problem of horizontal crosstalk, which reduces the display effect of the display panel. In other words, an influence of drift of the common voltage on the pixel voltages of the above three pixels leads to the problem of horizontal crosstalk.

Based on the generation mechanism of the horizontal crosstalk, in the embodiment of the present disclosure, the gray-scale voltage corresponding to the gray scale of the second image needs to be wholly drifted downwards, and an amount of drift should be the same as a reduced amount of the effective value of the common signal, so as to ensure that the pixel voltages of the three pixels are consistent, and eliminate the influence of the drift of the common voltage on the pixel voltages of the three pixels, so that the white line at the boundaries of the gray scales disappears. It should be noted that the reduced amount of the effective value of the common signal is related to characteristics of the display panel.

In order to solve the problem of horizontal crosstalk of the display panel, embodiments of the present disclosure provide a voltage compensation circuit, a voltage compensation method, a display driving circuit, and a display device.

Figure 2:
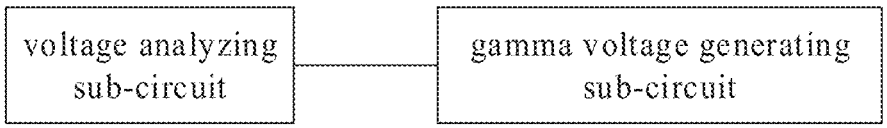
FIG. 2 is a schematic structural diagram of a voltage compensation circuit provided in an embodiment of the present disclosure.

An embodiment of the present disclosure provides a voltage compensation circuit, FIG. 2 is a schematic structural diagram of a voltage compensation circuit according to an embodiment of the present disclosure, as shown in FIG. 2, the voltage compensation circuit provided in the embodiment of the present disclosure is applied to a display panel, the display panel is configured for displaying an image to be detected and the voltage compensation circuit includes: a voltage analyzing sub-circuit and a gamma voltage generating sub-circuit.

Specifically, the voltage analyzing sub-circuit is coupled to the display panel and is configured for obtaining pixel voltages of target pixels in the image to be detected, judging whether the display panel is abnormal or not according to the pixel voltages, and generating a compensation control signal when the display panel is abnormal; the gamma voltage generating sub-circuit is coupled to the voltage analyzing sub-circuit and is configured for compensating a gamma voltage corresponding to the image to be detected according to the compensation control signal so as to enable the pixel voltages of the target pixels to be consistent.

Specifically, in this embodiment, the gamma voltage generating sub-circuit generates the gamma voltage corresponding to the image to be detected before compensating the gamma voltage according to the compensation control signal, and in this embodiment, the gamma voltage corresponding to the image to be detected generated before the compensation is referred to as an initial gamma voltage. The gamma voltage generating sub-circuit compensating the gamma voltage corresponding to the image to be detected according to the compensation control signal includes: the gamma voltage generating sub-circuit controlling a compensation of the initial gamma voltage according to the compensation control signal.

It should be noted that, the display panel being abnormal means that the display panel has a problem of horizontal crosstalk, and the pixel voltages of the target pixels being consistent means that a difference between the pixel voltages is smaller than a threshold, and the threshold is only required to be able to make the white line of the horizontal crosstalk be invisible to human eyes, and is not limited in the present embodiment.

Figure 3:
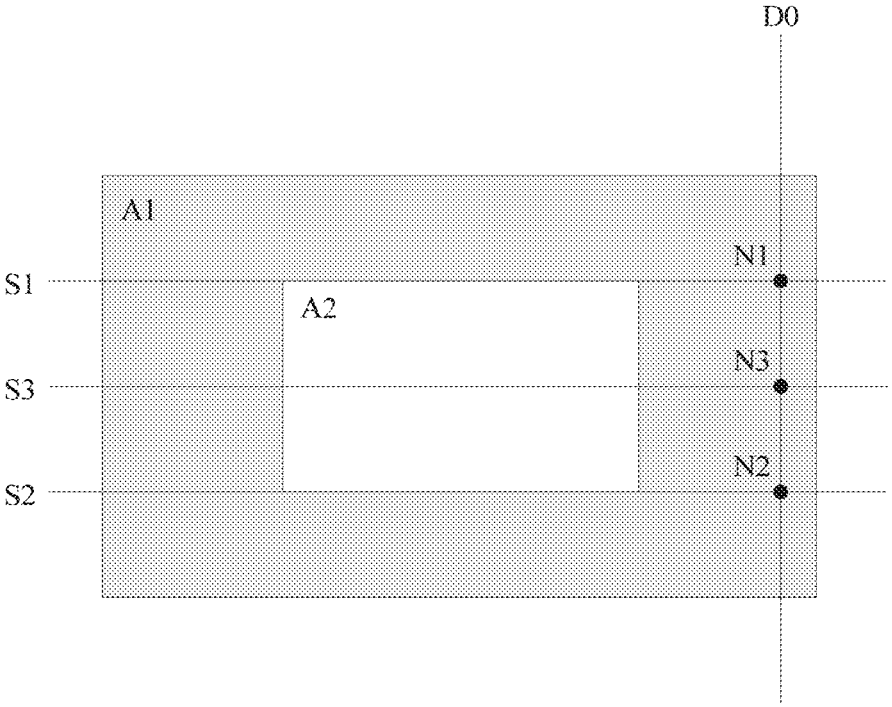
FIG. 3 is a schematic diagram of acquiring target pixels in an embodiment of the present disclosure.

FIG. 3 is a schematic diagram of acquiring target pixels according to an embodiment of the present disclosure, and as shown in FIG. 3, the image to be detected includes: a first display region A1 and a second display region A2; the first display region A1 surrounds the second display region A2; gray scales of contents displayed in the first display region A1 and the second display region A2 are different.

A length and a width of the first display region A1 are respectively the same as those of the display panel, for convenience of analysis, the second display region A2 is rectangular, and a length and a width of the second display region A2 are respectively half of those of the display panel, and it should be noted that the second display region A2 may also be of any other shape, and the length and the width of the second display region A2 may also be other values, which are not limited in this embodiment. It should be noted that FIG. 3 illustrates an example in which the gray scale of the content displayed in the first display region A1 is 63, and the gray scale of the content displayed in the second display region A2 is 255, but the present embodiment is not limited thereto.

It should be noted that edges of the second display region A2 in the image to be detected are positions of the display panel, where the horizontal crosstalk is most likely to occur, and in addition, even if the image to be detected displayed on the display panel has horizontal crosstalk, the problem of the horizontal crosstalk may be less obvious when the display panel displays a normal picture.

Specifically, in this embodiment, the gamma voltage generating sub-circuit is further configured to generate a target gamma voltage after compensating the gamma voltage according to the compensation control signal, so that the display panel performs display according to the target gamma voltage, where the target gamma voltage is a gamma voltage subjected to the compensating and enables the pixel voltages of the target pixels to be consistent.

It should be noted that, in this embodiment, before the gamma voltage generating sub-circuit compensating the gamma voltage, the gamma voltage corresponding to the image to be detected is the initial gamma voltage, and after the compensating, the gamma voltage corresponding to the image to be detected is the target gamma voltage, that is, before the compensating, the gamma voltage generating sub-circuit generates the initial gamma voltage, and after the compensating, the gamma voltage generating sub-circuit generates the target gamma voltage.

The voltage compensation circuit provided by the embodiment enables the pixel voltages of the target pixels to be consistent, and after the horizontal crosstalk generated when the display panel displays the image to be detected is improved, the problem of horizontal crosstalk cannot occur when the display panel displays a normal picture by utilizing the target gamma voltage, so that the display effect of the display panel can be improved.

In addition, as shown in FIG. 3, the display panel includes: M rows of scanning lines and N columns of data lines; the target pixels includes: a first pixel N1, a second pixel N2, and a third pixel N3.

M is greater than or equal to 1, N is greater than or equal to 1, and values of M and N are determined according to the display panel, which are not limited in this embodiment.

A first scanning line S1 is a scanning line located at a same horizontal line as an upper border of the second display region, a second scanning line S2 is a scanning line located at a same horizontal line as a lower border of the second display region, and a third scanning line S3 is a scanning line located between the first scanning line and the second scanning line.

Specifically, the first pixel N1 is a pixel defined by an intersection of the first scanning line S1 and the last column of data line D0, the second pixel is defined by an intersection of the second scanning line S2 and the last column of data line D0, and the third pixel is defined by an intersection of the third scanning line S3 and the last column of data line D0.

Taking FIG. 3 as an example, assuming that a height of the display panel is H, pixels defined by intersections of the scanning lines at positions of ¼H, ¾H and ½H from top to bottom in FIG. 3 and the last column of data line D0 are the first pixel N1, the second pixel N2 and the third pixel N3, respectively.

It should be noted that the third pixel N3 may be a pixel defined by an intersection of any scanning line between positions of ¼H and ¾H and the last column of data line, which is not limited in this embodiment.

In the present embodiment, the gamma voltage generating sub-circuit may generate a pair of gamma voltages, i.e., a positive frame gamma voltage and a negative frame gamma voltage, for each gray scale. For example, the gamma voltage generating sub-circuit in the embodiment generates fourteen gamma voltages for seven binding points, which are respectively V, V3 to V7, V9 to V10, V12 to V16 and V18, wherein V1, V3 to V7 and V9 are respectively greater than the common voltage and are positive frame gamma voltages, and the rest of the gamma voltages are lower than the common voltage and are negative frame gamma voltages, and it should be noted that an average value of the positive frame gamma voltages or the negative frame gamma voltages corresponding thereto is the common voltage, for example, V10 is the negative frame gamma voltage corresponding to V9, V12 is the negative frame gamma voltage corresponding to V7, V13 is the negative frame gamma voltage corresponding to V6, V14 is the negative frame gamma voltage corresponding to V5, V15 is the negative frame gamma voltage corresponding to V4, V16 is the negative frame gamma voltage corresponding to V3, and V18 is the negative gamma voltage corresponding to V1. The other reference voltages V2, V8, V11, and V17 are generated by internal voltage division of a source driving circuit.

In other words, each gray scale corresponds to two gamma voltages, i.e., a first gamma voltage and a second gamma voltage, where the first gamma voltage is a positive frame gamma voltage, and the second gamma voltage is a negative frame gamma voltage corresponding to the first gamma voltage, for example, if the gray scale is 63, the first gamma voltage corresponding to the gray scale is V6, the second gamma voltage corresponding to the gray scale is V13, if the gray scale is 31, the first gamma voltage corresponding to the gray scale is V5, and the second gamma voltage corresponding to the gray scale is V14, and so on.

Specifically, the gamma voltage generating sub-circuit of this embodiment adjusts the gamma voltage corresponding to the gray scale of the content displayed in the first display region A1, and as shown in FIG. 3, the gamma voltage generating sub-circuit adjusts V6 and V13, so that the pixel voltages of the target pixels are consistent.

In some implementations, the gamma voltage generating sub-circuit may be a programmable gamma buffer, which is not limited in this embodiment.

In addition, in the present disclosure, the improvement efficiency of horizontal crosstalk is improved and the labor cost is reduced by acquiring the pixel voltages of the target pixels in real time and automatically adjusting the pixel voltages. Dynamic compensation can adapt to different characteristics of the display panel and changes of TFT characteristics under different temperatures, and thus has a better improvement effect, a wider application range and a lower labor cost, and further can be extended to any other analysis of poor performance related to gamma voltage.

The voltage compensation circuit in the embodiment of this disclosure is applied to the display panel, and display panel includes: a plurality of pixels for displaying an image to be detected, the voltage compensation circuit includes: a voltage analyzing sub-circuit and a gamma voltage generating sub-circuit; the voltage analyzing sub-circuit is coupled to the display panel and configured for acquiring the pixel voltages of target pixels in the image to be detected, judging whether the display panel is abnormal or not according to the pixel voltages and generating a compensation control signal when the display panel is abnormal; and the gamma voltage generating sub-circuit is coupled to the voltage analyzing sub-circuit and is configured for compensating the gamma voltage corresponding to the image to be detected according to the compensation control signal so as to enable the pixel voltages of the target pixels to be consistent. According to the present disclosure, whether the display panel is abnormal or not can be analyzed by acquiring the pixel voltages of the target pixels in real time through the voltage analyzing sub-circuit, the gamma voltage is automatically adjusted through the gamma voltage generating sub-circuit when the display panel is abnormal, so that the pixel voltages of the target pixels are consistent, the influence of the drift of the common voltage on the pixel voltages of the target pixels is offset, the problem of horizontal crosstalk of the display panel is improved, and the display effect of the display panel is improved.

Figure 4:
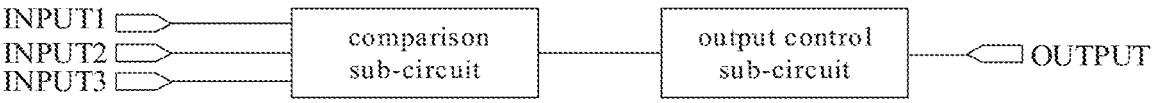
FIG. 4 is a schematic structural diagram of a voltage analyzing sub-circuit provided in an embodiment of the present disclosure.

In some implementations, FIG. 4 is a schematic structural diagram of a voltage analyzing sub-circuit according to an embodiment of the disclosure, and as shown in FIG. 4, the voltage analyzing sub-circuit according to the embodiment includes: a comparison sub-circuit and an output control sub-circuit. Specifically, input terminals of the comparison sub-circuit are coupled to a first signal input terminal INPUT1, a second signal input terminal INPUT2, and a third signal input terminal INPUT3, respectively, and the comparison sub-circuit is configured to obtain a first difference value and a second difference value according to signals of the first signal input terminal INPUT1, the second signal input terminal INPUT2, and the third signal input terminal INPUT3; where the $i^{th}$ signal input terminal is configured for providing a pixel voltage of the $i^{th}$ pixel, and i is greater than or equal to 1 and less than or equal to 3; the output control sub-circuit is respectively coupled to the comparison sub-circuit and a signal output terminal, and configured to judge whether the display panel is abnormal or not according to the first difference value and the second difference value, and generate the compensation control signal when the display panel is abnormal.

It should be noted that the $i^{th}$ signal input terminal is configured for providing the pixel voltage of the $i^{th}$ pixel, specifically, a wire is led out from a pixel electrode of the $i^{th}$ pixel, and an impedance of each of wires is matched with that of the display panel by ensuring that lengths of the wires are the same, so as to ensure that voltage losses are similar when the wires are coupled to the voltage analyzing sub-circuit. Specifically, the $i^{th}$ signal input terminal is specifically configured to provide the pixel voltage of the $i^{th}$ pixel, this embodiment is not limited thereto.

Figure 5:
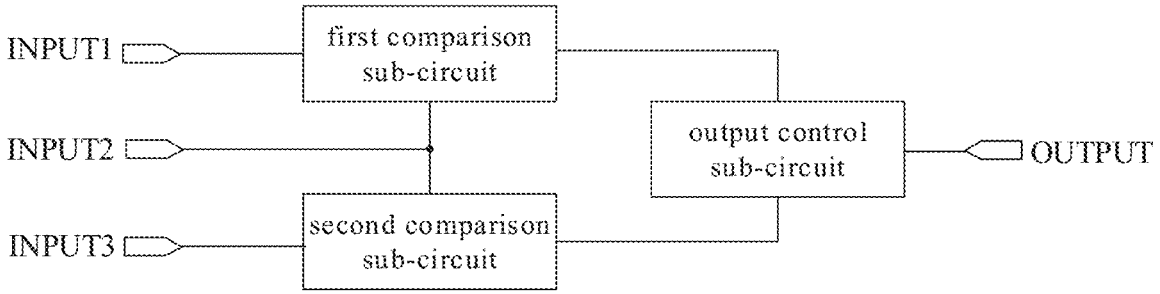
FIG. 5 is another schematic structural diagram of a voltage analyzing sub-circuit provided in an embodiment of the present disclosure.

For example, FIG. 5 is a schematic structural diagram of the voltage analyzing sub-circuit according to an embodiment of the disclosure, and as shown in FIG. 5, the comparison sub-circuit according to the embodiment includes: a first comparison sub-circuit and a second comparison sub-circuit.

Specifically, the first comparison sub-circuit is respectively coupled to the first signal input terminal INPUT1 and the second signal input terminal INPUT2, and is configured to obtain the first difference value according to signals of the first signal input terminal INPUT1 and the second signal input terminal INPUT2; and the second comparison sub-circuit is respectively coupled to the second signal input terminal INPUT2 and the third signal input terminal INPUT3, and is configured to obtain the second difference value according to signals of the second signal input terminal INPUT2 and the third signal input terminal INPUT3.

Figure 6:
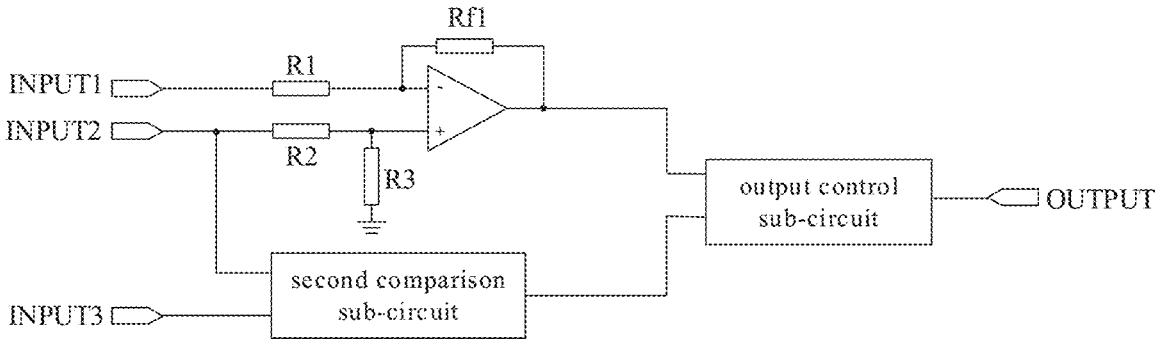
FIG. 6 is an equivalent circuit diagram of a first comparison sub-circuit provided in an embodiment of the present disclosure.

For example, FIG. 6 is an equivalent circuit diagram of the first comparison sub-circuit provided in the embodiment of the present disclosure, and as shown in FIG. 6, the first comparison sub-circuit provided in the embodiment includes: a first resistor R1, a second resistor R2, a third resistor R3, a first reference resistor Rf1 and a first subtractor.

A first terminal of the first resistor R1 is coupled to the first signal input terminal INPUT, and a second terminal of the first resistor R1 is coupled to a first input terminal of the first subtractor; a first terminal of the second resistor R2 is coupled to the second signal input terminal INPUT2, and a second terminal of the second resistor R2 is coupled to a second input terminal of the first subtractor; a first terminal of the third resistor R3 is coupled to the second input terminal of the first subtractor, and a second terminal of the third resistor R3 is grounded; a first terminal of the first reference resistor Rf1 is coupled to the first input terminal of the first subtractor, and a second terminal of the first reference resistor Rf1 is coupled to an output terminal of the first subtractor; the output terminal of the first subtractor is coupled to the output control sub-circuit.

The first resistor and the second resistor have a same resistance, and the third resistor and the first reference resistor have a same resistance.

According to the above analysis, it can be seen that the first difference value ΔV1 outputted by the first comparison sub-circuit satisfies:

$$\Delta V1 = \frac{Rf1}{R1}(V1 - V2)$$

Where V1 is the pixel voltage of the first pixel, V2 is the pixel voltage of the second pixel, Rf1 is the resistance of the first reference resistor, and R1 is the resistance of the first resistor.

In the present embodiment, an exemplary structure of the first comparison sub-circuit is specifically shown in FIG. 6. It is easily understood by those skilled in the art that the implementation of the first comparison sub-circuit is not limited thereto, as long as the function thereof can be achieved.

Figure 7:
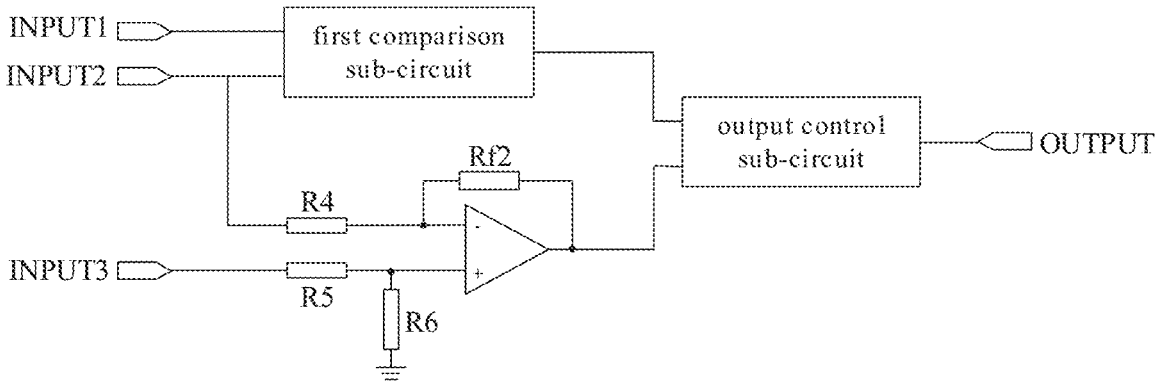
FIG. 7 is an equivalent circuit diagram of a second comparison sub-circuit provided in an embodiment of the present disclosure.

For example, FIG. 7 is an equivalent circuit diagram of the second comparison sub-circuit provided in the embodiment of the present disclosure, and as shown in FIG. 7, the second comparison sub-circuit provided in the embodiment of the present disclosure includes: a fourth resistor R4, a fifth resistor R5, a sixth resistor R6, a second reference resistor Rf2, and a second subtractor.

Specifically, a first terminal of the fourth resistor R4 is coupled to the second signal input terminal INPUT2, and a second terminal of the fourth resistor R4 is coupled to a first input terminal of the second subtractor; a first terminal of the fifth resistor R5 is coupled to the third signal input terminal INPUT3, and a second terminal of the fifth resistor R5 is coupled to a second input terminal of the second subtractor; a first terminal of the sixth resistor R6 is coupled to the second input terminal of the second subtractor, and a second terminal of the sixth resistor R6 is grounded; a first terminal of the second reference resistor Rf2 is coupled to the first input terminal of the second subtractor, and a second terminal of the second reference resistor Rf2 is coupled to an output terminal of the second subtractor; the output terminal of the second subtractor is coupled to the output control sub-circuit.

The fourth resistor and the fifth resistor have a same resistance, and the sixth resistor and the second reference resistor have a same resistance.

According to the above analysis, it can be seen that the second difference value ΔV2 outputted by the second comparison sub-circuit satisfies:

$$\Delta V2 = \frac{Rf2}{R4}(V2 - V3)$$

Where V3 is the pixel voltage of the third pixel, Rf2 is the resistance of the second reference resistor, and R4 is the resistance of the fourth resistor.

In the present embodiment, an exemplary structure of the second comparison sub-circuit is specifically shown in FIG. 7. It is easily understood by those skilled in the art that the implementation of the second comparison sub-circuit is not limited thereto, as long as the function thereof can be realized.

In order to ensure convenient analysis, the embodiment of the disclosure may make the resistance value of the second reference resistor equal to the resistance value of the fourth resistor, and the resistance value of the first reference resistor equal to the resistance value of the first resistor, that is, it is satisfied that:

$$\Delta V1=(V1-V2)\ \Delta V2=(V2-V3)$$

Specifically, in this embodiment, the output control sub-circuit is specifically configured to determine whether both the first difference value and the second difference value are less than a threshold, and determine that the display panel is abnormal when the first difference value or the second difference value is greater than or equal to the threshold.

In the above embodiment, for example, the first pixel may be the pixel N1 shown in FIG. 3, the second pixel may be the pixel N2 shown in FIG. 3, and the third pixel may be the pixel N3 shown in FIG. 3.

In some implementations, the threshold may be 0, or another value small enough to prevent the user from seeing the horizontal crosstalk, which is determined according to actual requirements, and is not limited in this embodiment.

Figure 8:
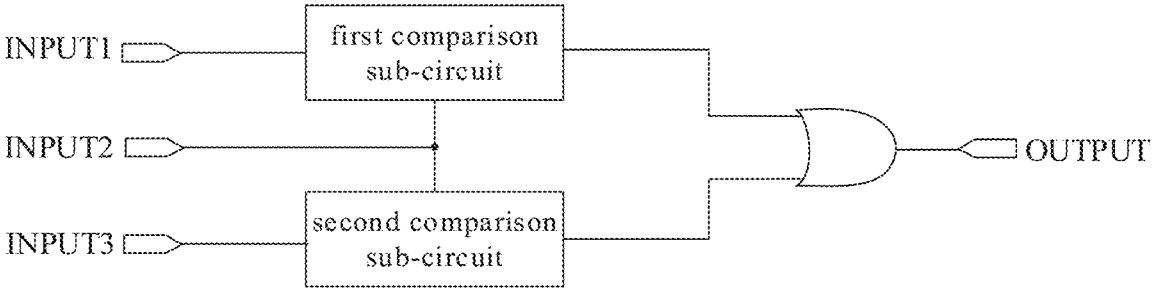
FIG. 8 is an equivalent circuit diagram of an output control sub-circuit provided in an embodiment of the present disclosure.

For example, FIG. 8 is an equivalent circuit diagram of the output control sub-circuit according to an embodiment of the disclosure, and as shown in FIG. 8, the output control sub-circuit according to the embodiment includes: an OR gate circuit.

Specifically, a first terminal of the OR gate circuit is coupled to an output terminal of the first subtractor, a second terminal of the OR gate circuit is coupled to the output terminal of the second subtractor, and an output terminal of the OR gate circuit is coupled to the signal output terminal OUTPUT.

In the present embodiment, an exemplary structure of the output control sub-circuit is specifically shown in FIG. 8. It is easily understood by those skilled in the art that the implementation of the output control sub-circuit is not limited thereto, as long as the function thereof can be realized.

When the first difference value and the second difference value are both less than the threshold, the OR gate circuit outputs a low level signal, and when the first difference value or the second difference value is greater than or equal to the threshold, the OR gate circuit outputs a high level compensation control signal, so that the gamma voltage generating sub-circuit is triggered to compensate the gamma voltage.

It should be noted that terms "high level" and "low level" in this embodiment respectively refer to two logic states represented by a potential level range at a certain circuit node position, and the potential level range may be specifically set as needed in a specific application scenario, and is not limited by the embodiment of the present disclosure.

Figure 9:
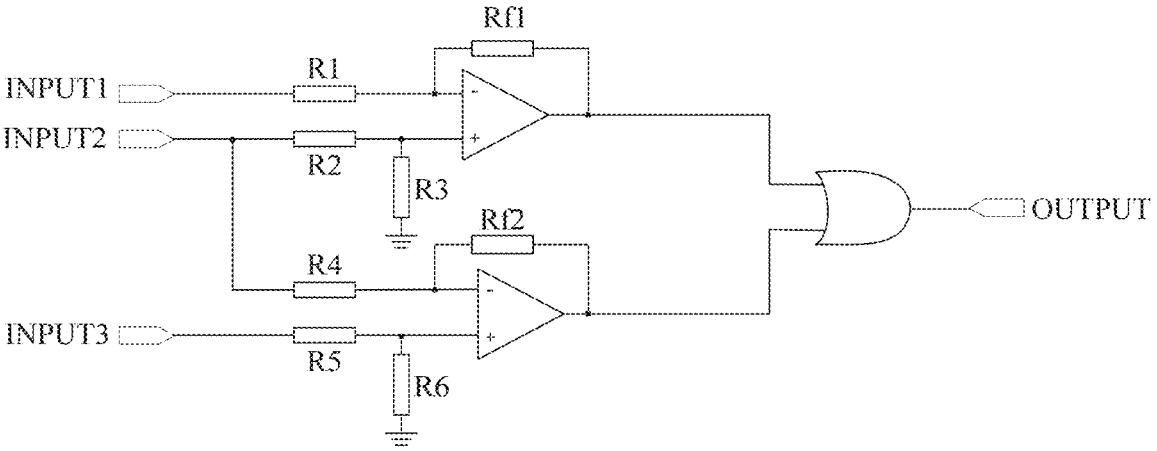
FIG. 9 is an equivalent circuit diagram of a voltage analyzing sub-circuit provided in an embodiment of the present disclosure.

For example, FIG. 9 is an equivalent circuit diagram of the voltage analyzing sub-circuit provided in an embodiment of the present disclosure, and as shown in FIG. 9, the voltage analyzing sub-circuit provided in the embodiment of the present disclosure includes: the first resistor R1, the second resistor R2, the third resistor R3, the first reference resistor Rf1, the first subtractor, the fourth resistor R4, the fifth resistor R5, the sixth resistor R6, the second reference resistor Rf2, the second subtractor and the OR gate circuit.

The first terminal of the first resistor R1 is coupled to the first signal input terminal INPUT1, and the second terminal of the first resistor R1 is coupled to the first input terminal of the first subtractor; the first terminal of the second resistor 2 is coupled to the second signal input terminal INPUT2, and the second terminal of the second resistor 2 is coupled to the second input terminal of the first subtractor; the first terminal of the third resistor R3 is coupled to the second input terminal of the first subtractor, and the second terminal of the third resistor R3 is grounded; the first terminal of the first reference resistor Rf1 is coupled to the first input terminal of the first subtractor, and the second terminal of the first reference resistor Rf1 is coupled to the output terminal of the first subtractor; the output terminal of the first subtractor is coupled to the first input terminal of the OR gate circuit; the first terminal of the fourth resistor R4 is coupled to the second signal input terminal INPUT2, and the second terminal of the fourth resistor R4 is coupled to the first input terminal of the second subtractor; the first terminal of the fifth resistor R5 is coupled to the third signal input terminal INPUT3, and the second terminal of the fifth resistor R5 is coupled to the second input terminal of the second subtractor; the first terminal of the sixth resistor R6 is coupled to the second input terminal of the second subtractor, and the second terminal of the sixth resistor R6 is grounded; the first terminal of the second reference resistor Rf2 is coupled to the first input terminal of the second subtractor, and the second terminal of the second reference resistor Rf2 is coupled to the output terminal of the second subtractor; the output terminal of the second subtractor is coupled to the second input terminal of the OR gate circuit; and the output terminal of the OR gate circuit is coupled to the signal output terminal OUTPUT.

Specifically, the gamma voltage generating sub-circuit is specifically configured to compensate the gamma voltage corresponding to the gray scale of the second display region by using the threshold compensation voltage according to the compensation control signal, until the pixel voltages of the target pixels are consistent. It should be noted that the voltage analyzing sub-circuit is further configured to continuously obtain pixel voltages of target pixels in the image to be detected, determine whether the display panel is abnormal according to the pixel voltages, and generate a compensation control signal when the display panel is abnormal, and the gamma voltage generating sub-circuit is further configured to continuously compensate the gamma voltage corresponding to the gray scale of the second display region by using the threshold compensation voltage according to the compensation control signal, until the pixel voltages of the target pixels are consistent, that is, the gamma voltage generating sub-circuit stops compensating the gramma voltage when the pixel voltages of the target pixels are consistent.

Figure 10:
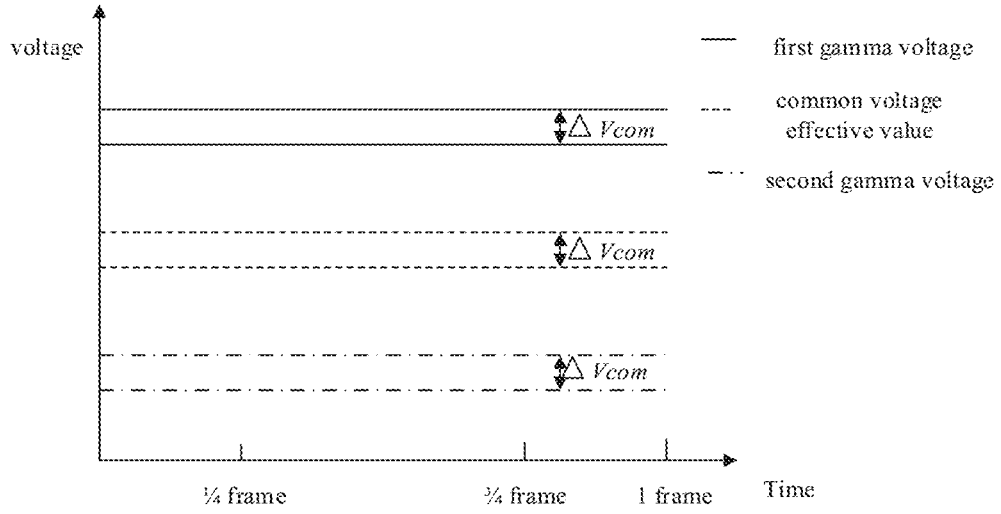
FIG. 10 is a schematic diagram illustrating variations of a compensated voltage according to an embodiment of the present disclosure.
Figure 11:
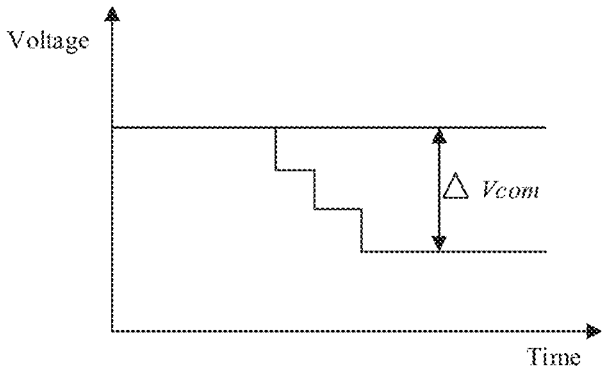
FIG. 11 is a schematic diagram illustrating gradient of a gamma voltage according to an embodiment of the disclosure.

Specifically, FIG. 10 is a schematic diagram of changes of a compensated voltage according to an embodiment of the disclosure, and FIG. 11 is a schematic diagram of gradient of a gamma voltage according to an embodiment of the disclosure. As shown in FIG. 10, after compensating the gamma voltage, change amounts of two gamma voltages corresponding to the gray scales, i.e., the first gamma voltage and the second gamma voltage, are the same as a change amount of an effective value of the common voltage, and the effective value of the common voltage is at a middle between the two gamma voltages, i.e., the first gamma voltage and the second gamma voltage change in phase with the common voltage. As shown in FIG. 11, the voltages refer to the first gamma voltage and the second gamma voltage, and the voltages are compensated by a threshold compensation voltage.

The threshold compensation voltage is a fixed value and is a binding point voltage of the gamma voltage generating sub-circuit.

In some implementations, the threshold compensation voltage ranges from 10 mv to 50 mv, the smaller the value of the threshold compensation voltage is, the more accurate the voltage compensation circuit is compensated, the specific value of the threshold compensation voltage is determined according to the display panel, and is not limited in this embodiment of the disclosure.

Based on the same inventive concept, an embodiment of the present disclosure further provides a voltage compensation method, which is applied to the voltage compensation circuit, and the voltage compensation method provided by this embodiment specifically includes the following steps 100 and 200.

At step 100, the voltage analyzing sub-circuit obtains the pixel voltages of the target pixels in the image to be detected, judges whether the display panel is abnormal according to the pixel voltages, and generates a compensation control signal when the display panel is abnormal.

The voltage analyzing sub-circuit judging whether the display panel is abnormal according to the pixel voltages specifically includes: the voltage analyzing sub-circuit obtains a first difference value according to signals of the first signal input terminal and the second signal input terminal, and obtains a second difference value according to signals of the second signal input terminal and the third signal input terminal, and judges whether the first difference value and the second difference value are both smaller than a threshold value, and determines that the display panel is abnormal when the first difference value or the second difference value is greater than or equal to the threshold value.

The target pixels includes: a first pixel, a second pixel, and a third pixel; the $i^{th}$ signal input terminal (INPUT1, INPUT2 or INPUT3) is configured for providing the pixel voltage of the $i^{th}$ pixel (the first pixel, the second pixel or the third pixel), i is greater than or equal to 1 and less than or equal to 3, and i is an integer.

It should be noted that, the display panel being abnormal in this embodiment means that the display panel has a problem of horizontal crosstalk.

At step 200, the gamma voltage generating sub-circuit compensates the gamma voltage corresponding to the image to be detected according to the compensation control signal so as to enable the pixel voltages of the target pixels are consistent.

The gamma voltage generating sub-circuit compensating the gamma voltage corresponding to the image to be detected according to the compensation control signal specifically includes: the gamma voltage generating sub-circuit compensates the gamma voltage corresponding to the gray scale of the second display region by using the threshold compensation voltage according to the compensation control signal, until the pixel voltages of the target pixels are consistent, specifically, the gamma voltage generating sub-circuit compensates the gamma voltage corresponding to the gray scale of the second display region by using the threshold compensation voltage according to the compensation control signal, the voltage analyzing sub-circuit continuously obtains the pixel voltages of the target pixels in the image to be detected, judges whether the display panel is abnormal according to the pixel voltages, generates a compensation control signal when the display panel is abnormal, and the gamma voltage generating sub-circuit continuously compensates the gamma voltage corresponding to the gray scale of the second display region by adopting the threshold compensation voltage according to the compensation control signal, until the pixel voltages of the target pixels are consistent, that is to say, the gamma voltage generating sub-circuit stops compensating the gamma voltage when the pixel voltages of the target pixels are consistent.

The threshold compensation voltage is a fixed value, in some implementations, the threshold compensation voltage ranges from 10 my to 50 mv, a specific value of the threshold compensation voltage is determined according to the display panel, and is not limited in this embodiment.

The voltage compensation method provided by this embodiment is applied to the voltage compensation circuit, and the implementation principle and the implementation effect are similar to those of the voltage compensation circuit, and thus are not described here again.

Based on the same inventive concept, an embodiment of the present disclosure further provides a display driving circuit, which includes the above voltage compensation circuit.

Specifically, the display driving circuit further includes: a time sequence control circuit, a power supply management integrated circuit, a level conversion circuit, a gate driving circuit and a source driving circuit, where the gate driving circuit is coupled to the time sequence control circuit and the level conversion circuit, and the source driving circuit is coupled to the power supply management integrated circuit.

The display driving circuit provided by this embodiment includes the voltage compensation circuit, and the implementation principle and the implementation effect thereof are similar to those of the voltage compensation circuit, and will not be described here again.

Figure 12:
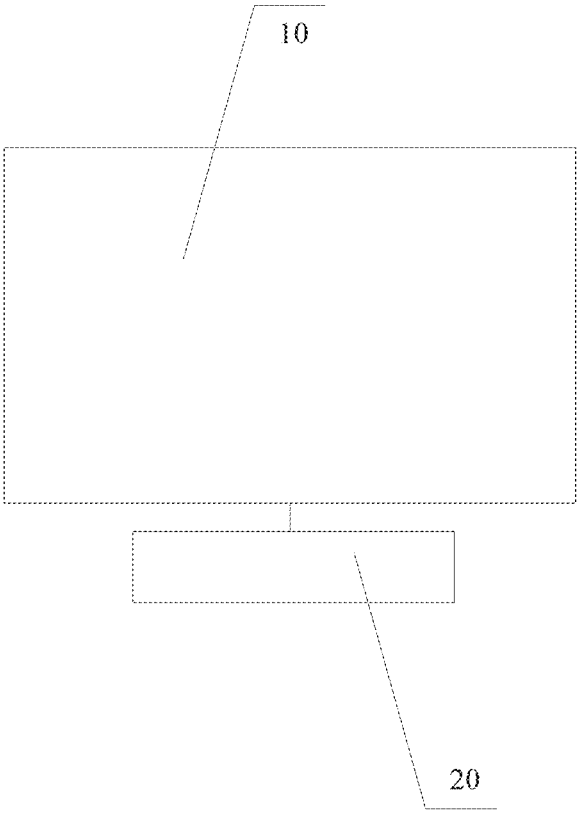
FIG. 12 is a schematic structural diagram of a display device according to an embodiment of the disclosure.

Based on the inventive concept of the above embodiments, an embodiment of the present disclosure further provides a display device, FIG. 12 is a schematic structural diagram of the display device provided in this embodiment, and as shown in FIG. 12, the display device provided in the embodiment of the present disclosure includes: a display panel 10 and a display driving circuit 20. The display driving circuit is the above display driving circuit, and the implementation principle and the implementation effect of the display device are similar to those of the display driving circuit, and are not described here again.

Specifically, the display driving circuit 20 is configured for driving the display panel 10 to display.

Specifically, the display device may be any product or component having a display function, such as a mobile phone, a tablet computer, a television, a display, a notebook computer, a digital photo frame, and a navigator, which is not limited in the embodiments of the present disclosure.

It should be noted that the display device described in the embodiment of the present disclosure may be of a Twisted Nematic (TN) mode, a Vertical Alignment (VA) mode, an In-plane Switching (IPS) mode, or an advanced super Dimension Switching (ADS) mode, which is not limited in any way by the present disclosure.

The drawings of the embodiments of the present disclosure only relate to the structures related to the embodiments of the present disclosure, and other structures can refer to common designs.

In the drawings used to describe embodiments of the present disclosure, thicknesses and sizes of layers or microstructures are exaggerated for clarity. It will be understood that when an element such as a layer, film, region or substrate is referred to as being "on" or "under" another element, it may be directly "on" or "under" the other element or intervening elements may be present therebetween.

Without conflict, the embodiments of the present disclosure, i.e., features of the embodiments, may be combined with each other to obtain new embodiments.

Although the embodiments of the present disclosure are described above, the descriptions are only for the purpose of understanding the present disclosure, and are not intended to limit the present disclosure. It will be understood by those skilled in the art of the present disclosure that various changes in form and details may be made without departing from the spirit and scope of the present disclosure, and the protection scope of the present disclosure is to be limited only by the appended claims.

What is claimed is:

1. A voltage compensation circuit for a display panel, wherein the display panel is configured to display an image to be detected, the voltage compensation circuit comprising: a voltage analyzing sub-circuit and a gamma voltage generating sub-circuit, the voltage analyzing sub-circuit is coupled to the display panel and is configured to acquire pixel voltages of target pixels in the image to be detected, judge whether the display panel is abnormal or not according to the pixel voltages; and generate a compensation control signal in response to that the display panel is abnormal; and the gamma voltage generating sub-circuit is coupled to the voltage analyzing sub-circuit and is configured to compensate a gamma voltage corresponding to the image to be detected according to the compensation control signal so as to enable the pixel voltages of the target pixels to be consistent, wherein the image to be detected comprises: a first display region and a second display region, the first display region surrounds the second display region;

the display panel comprises M rows of scanning lines and N columns of data lines, the target pixels comprise a first pixel, a second pixel and a third pixel, wherein M is greater than or equal to 1, and N is greater than or equal to 1;

the first pixel is defined by an intersection of a first scanning line and a last column of a data line, the second pixel is defined by an intersection of a second scanning line and the last column of the data line, and the third pixel is defined by an intersection of a third scanning line and the last column of the data line;

the first scanning line is a scanning line which is located at a same horizontal line as an upper border of the second display region, the second scanning line is a scanning line which is located at a same horizontal line as a lower border of the second display region, and the third scanning line is a scanning line located between the first scanning line and the second scanning line, and wherein the voltage analyzing sub-circuit comprises a comparison sub-circuit and an output control sub-circuit, the comparison sub-circuit is respectively coupled to a first signal input terminal, a second signal input terminal and a third signal input terminal and is configured to obtain a first difference value and a second difference value according to signals from the first signal input terminal, the second signal input terminal and the third signal input terminal; the first signal input terminal is configured to provide a pixel voltage of the first pixel, the second signal input terminal is configured to provide a pixel voltage of the second pixel, and the third signal input terminal is configured to provide a pixel voltage of the third pixel;

the output control sub-circuit is respectively coupled to the comparison sub-circuit and a signal output terminal as is configured to judge whether the display panel is abnormal or not according to the first difference value and the second difference value, generate the compensation control signal in response to that the display panel is abnormal and provide the compensation control signal to the signal output terminal.

2. The voltage compensation circuit of claim 1, wherein the gamma voltage generating sub-circuit is further configured to generate a target gamma voltage to configure the display panel to display according to the target gamma voltage, and wherein the target gamma voltage is a gamma voltage which is compensated and enables the pixel voltages of the target pixels to be consistent.

3. A display driving circuit, comprising: the voltage compensation circuit of claim 2.

4. The voltage compensation circuit of claim 1, wherein the comparison sub-circuit comprises a first comparison sub-circuit and a second comparison sub-circuit;

the first comparison sub-circuit is respectively coupled to the first signal input terminal and the second signal input terminal, and is configured to obtain the first difference value according to signals of the first signal input terminal and the second signal input terminal;

the second comparison sub-circuit is respectively coupled to the second signal input terminal and the third signal input terminal, and is configured to obtain the second difference value according to signals of the second signal input terminal and the third signal input terminal.

5. The voltage compensation circuit of claim 4, wherein the first comparison sub-circuit comprises a first resistor, a second resistor, a third resistor, a first reference resistor and a first subtractor;

a first terminal of the first resistor is coupled to the first signal input terminal, and a second terminal of the first resistor is coupled to a first input terminal of the first subtractor;

a first terminal of the second resistor is coupled to the second signal input terminal, and a second terminal of the second resistor is coupled to a second input terminal of the first subtractor;

a first terminal of the third resistor is coupled to the second input terminal of the first subtractor, and a second terminal of the third resistor is grounded;

a first terminal of the first reference resistor is coupled to the first input terminal of the first subtractor, and a second terminal of the first reference resistor is coupled to an output terminal of the first subtractor;

the output terminal of the first subtractor is coupled to the output control sub-circuit, wherein the first resistor and the second resistor has a same resistance value, and the third resistor and the first reference resistor has a same resistance value.

6. A display driving circuit, comprising: the voltage compensation circuit of claim 5.

7. The voltage compensation circuit of claim 4, wherein the second comparison sub-circuit comprises a fourth resistor, a fifth resistor, a sixth resistor, a second reference resistor and a second subtractor;

a first terminal of the fourth resistor is coupled to the second signal input terminal, and a second terminal of the fourth resistor is coupled to a first input terminal of the second subtractor;

a first terminal of the fifth resistor is coupled to the third signal input terminal, and a second terminal of the fifth resistor is coupled to a second input terminal of the second subtractor;

a first terminal of the sixth resistor is coupled to the second input terminal of the second subtractor, and a second terminal of the sixth resistor is grounded;

a first terminal of the second reference resistor is coupled to the first input terminal of the second subtractor, and a second terminal of the second reference resistor is coupled to an output terminal of the second subtractor;

the output terminal of the second subtractor is coupled to the output control sub-circuit;

wherein the fourth resistor and the fifth resistor has a same resistance value, and the sixth resistor and the second reference resistor has a same resistance value.

8. A display driving circuit, comprising: the voltage compensation circuit of claim 7.

9. A display driving circuit, comprising: the voltage compensation circuit of claim 4.

10. The voltage compensation circuit of claim 1, wherein the output control sub-circuit is configured to determine whether the first difference value and the second difference value are both less than a threshold value, and determine that the display panel is abnormal in response to that the first difference value or the second difference value is greater than or equal to the threshold value.

11. The voltage compensation circuit of claim 10, wherein the output control sub-circuit comprises an OR gate circuit;

a first terminal of the OR gate circuit is coupled to the output terminal of the first subtractor, a second terminal of the OR gate circuit is coupled to the output terminal of the second subtractor, and an output terminal of the OR gate circuit is coupled to the signal output terminal.

12. A display driving circuit, comprising: the voltage compensation circuit of claim 11.

13. A display driving circuit, comprising: the voltage compensation circuit of claim 10.

14. The voltage compensation circuit of claim 1, wherein the voltage analyzing sub-circuit comprises a first resistor, a second resistor, a third resistor, a first reference resistor, a first subtractor, a fourth resistor, a fifth resistor, a sixth resistor, a second reference resistor, a second subtractor and an OR gate circuit, wherein, a first terminal of the first resistor is coupled to a first signal input terminal, and a second terminal of the first resistor is coupled to a first input terminal of the first subtractor;

a first terminal of the second resistor is coupled to a second signal input terminal, and a second terminal of the second resistor is coupled to a second input terminal of the first subtractor;

a first terminal of the third resistor is coupled to the second input terminal of the first subtractor, and a second terminal of the third resistor is grounded;

a first terminal of the first reference resistor is coupled to the first input terminal of the first subtractor, and a second terminal of the first reference resistor is coupled to an output terminal of the first subtractor;

the output terminal of the first subtractor is coupled to a first input terminal of the OR gate circuit;

a first terminal of the fourth resistor is coupled to the second signal input terminal, and a second terminal of the fourth resistor is coupled to a first input terminal of the second subtractor;

a first terminal of the fifth resistor is coupled to a third signal input terminal, and a second terminal of the fifth resistor is coupled to a second input terminal of the second subtractor;

a first terminal of the sixth resistor is coupled to the second input terminal of the second subtractor, and a second terminal of the sixth resistor is grounded;

a first terminal of the second reference resistor is coupled to the first input terminal of the second subtractor, and a second terminal of the second reference resistor is coupled to an output terminal of the second subtractor;

the output terminal of the second subtractor is coupled to a second input terminal of the OR gate circuit; and an output terminal of the OR gate circuit is coupled to the signal output terminal.

15. The voltage compensation circuit of claim 1, wherein the gamma voltage generating sub-circuit is configured to compensate the gamma voltage corresponding to a gray scale of the second display region by using a threshold compensation voltage according to the compensation control signal, until the pixel voltages of the target pixels are consistent.

16. A display driving circuit, comprising: the voltage compensation circuit of claim 1.

17. A display device, comprising: the display panel and the display driving circuit of claim 16.

18. A voltage compensation method applied to the voltage compensation circuit of claim 1, the voltage compensation method comprising:

obtaining, by the voltage analyzing sub-circuit, pixel voltages of target pixels in an image to be detected, judging, by the voltage analyzing sub-circuit, whether the display panel is abnormal or not according to the pixel voltages, and generating, by the voltage analyzing sub-circuit, the compensation control signal in response to that the display panel is abnormal; and compensating, by the gamma voltage generating sub-circuit, the gamma voltage corresponding to the image to be detected according to the compensation control signal so as to enable the pixels voltages of the target pixels to be consistent.

19. The voltage compensation method of claim 18, wherein the voltage analyzing sub-circuit judging whether the display panel is abnormal or not according to the pixel voltages comprises:

obtaining, by the voltage analyzing sub-circuit, a first difference value according to signals of the first signal input terminal and the second signal input terminal, obtaining, by the voltage analyzing sub-circuit, a second difference value according to signals of the second signal input terminal and the third signal input terminal, judging, by the voltage analyzing sub-circuit, whether the first difference value and the second difference value are both smaller than a threshold value, and determining, by the voltage analyzing sub-circuit, that the display panel is abnormal in response to that the first difference value or the second difference value is greater than or equal to the threshold value;

wherein the target pixels comprises a first pixel, a second pixel, and a third pixel, the first signal input terminal is configured to provide a pixel voltage of the first pixel, the second signal input terminal is configured to provide a pixel voltage of the second pixel, and the third signal input terminal is configured to provide a pixel voltage of the third pixel.

20. The voltage compensation method of claim 18, wherein compensating, by the gamma voltage generating sub-circuit, the gamma voltage corresponding to the image to be detected according to the compensation control signal comprises: compensating, by the gamma voltage generating sub-circuit, the gamma voltage corresponding to a gray scale of the second display region according to the compensation control signal by using a threshold compensation voltage, until the pixel voltages of the target pixels are consistent.

* * * * *